United States Patent [19]

Horiuchi

[11] 3,967,088

[45] June 29, 1976

[54] GAP DETECTOR FOR MICROWAVE OVEN

[75] Inventor: Masao Horiuchi, Tenri, Japan

[73] Assignee: Matsushita Electric Industrial Co., Ltd., Osaka, Japan

[22] Filed: Dec. 9, 1973

[21] Appl. No.: 530,841

[30] Foreign Application Priority Data

Dec. 14, 1973 Japan ..... 48-140609

[52] U.S. Cl. ..... 219/10.55 C; 200/50 A

[51] Int. Cl.[2] ..... H05B 9/06

[58] Field of Search ..... 219/10.55 C, 10.55 B, 219/412, 413; 200/50 A; 126/197, 190, 200

[56] References Cited

UNITED STATES PATENTS

| | | | |
|---|---|---|---|
| 3,715,552 | 2/1973 | Umezu et al. | 219/10.55 C |
| 3,715,553 | 2/1973 | Ogawa et al. | 219/10.55 C |
| 3,715,554 | 2/1973 | Umezu et al. | 219/10.55 C |
| 3,733,456 | 5/1973 | Blackburn | 219/10.55 C |
| 3,784,776 | 1/1974 | Asanuma | 219/10.55 C |
| 3,816,688 | 6/1974 | Fritts | 219/10.55 C |
| 3,823,294 | 7/1974 | Takayama et al. | 219/10.55 C |

*Primary Examiner*—Arthur T. Grimley
*Attorney, Agent, or Firm*—Wenderoth, Lind & Ponack

[57] ABSTRACT

A microwave oven comprises a double-walled housing structure and a hingedly supported door and a door interlocking mechanism for locking the door in locked position to close an access opening communicating to the interior of the microwave oven. In addition to a switch operatively coupled to the interlocking mechanism, which is closed upon closure of the door, a detector device is provided for rendering the high frequency wave oscillator inoperative when the door in the locked position is to be moved from the closed position towards the opened position by the application of an external pulling force thereto or when a foreign matter is jammed in between the door and the front of the microwave oven. The detector device may comprise any of a detector switch, which may be in the form of a microswitch or a pressure sensitive element, or a pivotable lever.

20 Claims, 7 Drawing Figures

GAP DETECTOR FOR MICROWAVE OVEN

BACKGROUND OF THE INVENTION

The present invention relates to a microwave oven of a type having a door locking mechanism.

In most microwave ovens, an interlocking mechanism is generally employed for rendering a high frequency wave oscillator, for example, a magnetron, inoperative when a door, which has been in position to close an access opening communicating with the oven chamber, is opened during operation of the high frequency wave oscillator. The interlocking mechanism employed for this purpose is mainly composed of a switch for opening an electric circuit of the high frequency wave oscillator and a door key provided in the door for operating the switch. Accordingly, in a condition wherein the door is closed, the door is locked in the closed position by the door key.

The door employed in most microwave ovens heretofore commercially available tends to warp or deform when it receives an external force, the value of which external force varies depending upon the type of material for the door. Accordingly, for example, when the door is to be opened without the door key properly handled during closure of the door, the door tends to deform by the application of an external force applied to the door so as to open the latter. Moreover, since the interlocking mechanism is not completely released under this condition, the high frequency wave oscillator continues radiating a high-frequency electromagnetic energy or microwave into the oven chamber. As a result thereof, a gap is formed between the door and a portion of an oven casing structure located around the access opening, from which gap leakage of high-frequency electromagnetic energy will occur. As is well known to those skilled in the art, leakage of the high-frequency electromagnetic energy is hazardous to the human body.

A similar condition as hereinabove described will occur even when a foreign matter, for example, a piece of paper, towel and napkin, is caught or jammed in between the door and that portion of the oven casing structure as the door is closed and/or when a solidified body of spillage of food particles and grease spatterings piles on one or both of the door and that portion of the oven casing structure while the microwave oven is frequently used for a substantially long period of time. When the door is forcibly closed jamming a piece of paper, towel or napkin or a solidified body of spillage of food particles or grease spatterings between the door and that portion of the casing structure, the door tends to deform, thereby forming a gap between the door and that portion of the oven casing structure while it is held in the closed position and the door key is in position to operate the switch. If the high frequency wave oscillator is operated under this condition, a user or operator of the microwave oven is susceptible to high-frequency electromagnetic energy leaking through the gap thus formed between the door and that portion of the oven casing structure.

Furthermore, most users or operators of the microwave oven seldom follow a how-to-use instructions furnished by the manufacturer and, therefore, during normal use, a piece of napkin or towel which is frequently used in kitchens is often jammed in between the door of the oven and that portion of the oven casing structure. What is jammed in between the door of the microwave oven and that portion of the oven casing structure is not always limited to that described above, but it may include chopsticks, toothpicks, and a spillage of food particulars which may remain unremoved and is solidified because of insufficient cleaning of the microwave oven interior. It is true that the greater the gap, the greater the amount of microwave leakage, and the leakage of microwave energy should be strictly avoided.

SUMMARY OF THE INVENTION

Accordingly, an essential object of the present invention is to provide a microwave oven wherein means is provided for detecting an increase of the size of a gap, which may be formed between the door and an adjacent portion of the oven casing structure, resulting from deformation of the door relative to the oven casing structure due to a foreign matter jammed in between the door and the oven casing structure, such detecting means being capable of rendering the high frequency wave oscillator inoperative upon detection of the increase of the gap size so that microwave radiation hazard can be avoided.

Another important object of the present invention is to provide a microwave oven of the type referred to above, wherein the detecting means is operatively associated with the interlocking mechanism so that the user may feel comfortable to handle and that the number of components parts can be minimized with the manufacturing cost lowered.

A further object of the present invention is to provide a microwave oven of the type referred to above, wherein the detecting means comprises a microswitch which is operated in response to movement of the door from the closed position to the opened position, the use of which microswitch ensures a compact structure of the detecting means with an improved reliability in operation.

A still further object of the present invention is to provide a microwave oven of the type referred to above, wherein the detecting means is incorporated in the door interlocking mechanism to simplify the overall structure with an improved reliability in operation, thereby substantially reducing manufacturing cost of the microwave oven.

A still further object of the present invention is to provide a safety device for rendering the high frequency wave oscillator inoperative during abnormal use or deformation of the door, which safety device comprises a pivotable lever which can be installed in any of the conventionally available microwave ovens.

A still further object of the present invention is to provide a microwave oven of the type referred to above, wherein the detecting means comprises a pressure sensitive element capable of detecting an external force excessively applied to the door so that the high frequency wave oscillator can be rendered inoperative.

A still further object of the present invention is to provide a microwave oven of the type referred to above, wherein the pressure sensitive element is supported through a piece of elastic material for protecting the pressure sensitive element.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
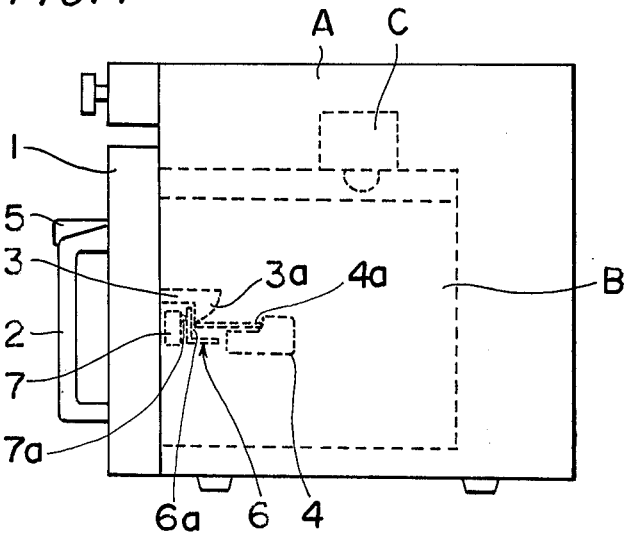
FIG. 1 is a schematic side view of a microwave oven incorporating a detecting means according to one preferred embodiment of the present invention.

Before the description of the present invention proceeds, it should be noted that like parts are designated by like reference numerals throughout the accompanying drawings.

Figure 2:
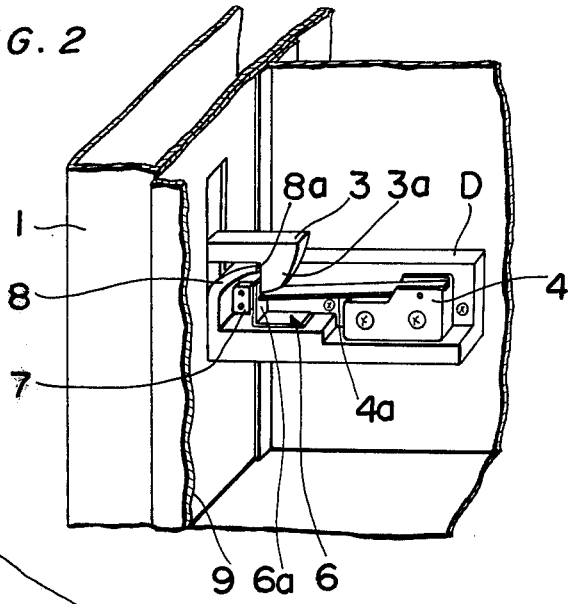
FIG. 2 is a perspective view, on an enlarged scale, of an essential portion of the microwave oven of FIG. 1 showing the details of the detecting means.
Figure 3:
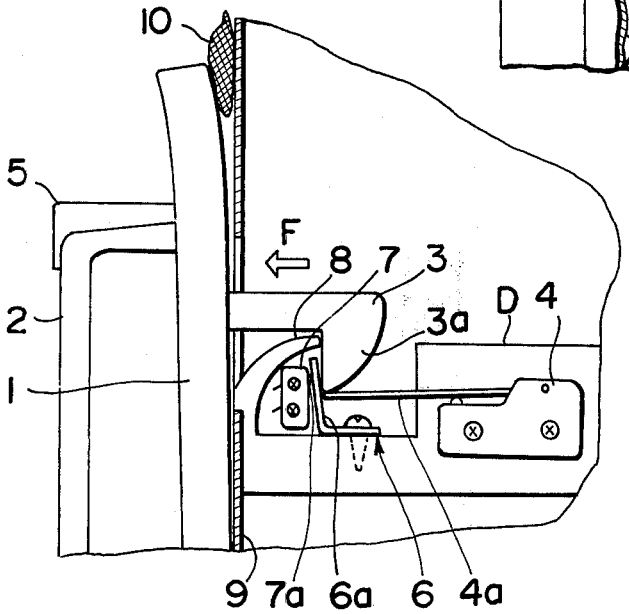
FIG. 3 is a side sectional view of the essential portion of the microwave oven, showing the detecting means in an operated condition due to deformation of the door resulting from a foreign matter jammed in between the door and the oven casing structure.

Referring first to FIGS. 1 to 3 in which a first preferred embodiment of the present invention is shown, a microwave oven comprises an outer casing A open at one side thereof and an oven-defining metallic enclosure B within and spaced from outer casing A, enclosure B having an access opening generally coincident with the open side of outer casing A. A high frequency wave oscillator C, for example, a magnetron, is stationarily mounted on the enclosure B within a space between the outer casing A and the enclosure B, which high frequency wave oscillator C when energized radiates high-frequency electromagnetic energy into the interior of the enclosure B. A door 1 is hinged to the open side of the outer casing A for selectively closing and opening the access opening communicating to the interior of the enclosure B. The door 1 is provided with a door key 3 having one end formed into a hook 3*a* and the other end operatively linked to a handle piece 5 which is pivotally supported to a handle 2 rigidly secured to the outer surface of the door 1. It should be noted that, by the action of any suitable biasing element, such as a tension spring as shown by 15 in FIG. 5, the door key 3 is normally biased to an engaged position, movement of door key 3 to a disengaged position against the biasing element being effected when handle piece 5 is depressed and the door 1 is outwardly pulled. Associated with the hook 3*a* of the door key 3 is a stopper 8 of a construction as will be described later, which stopper 8 is stationarily held in position within the space between the outer casing A and the enclosure B and adjacent the access opening.

The arrangement so far described is well known to those skilled in the art and it is clear that, as the door 1 assuming an opened position wherein the access opening is opened is pivoted to a closed position in readiness for closure of the access opening, a curved front of the door hook 3*a* slides over the curved stopper 8 with the door key 3 upwardly rotated about the pivot (not shown) against the biasing element and then assumes the engaged position as shown in FIGS. 1 to 3. In this condition, unless the handle piece 5 is depressed while the door 1 is outwardly pulled, the door 1 will not open because the hook 3*a* is engaged with the free end 8*a* of the stopper 8.

Within the space between the outer casing A and the enclosure B and adjacent the door hook 3*a* of the door key 3 when assuming the engaged position, there is provided an interlock switch 4 having an actuating lever 4*a* extending therefrom to a position immediately below the hook 3*a*. The interlock switch 4 is designed such that, as the door hook 3*a* which has slid over the stopper 8 pivots to the engaged position, the actuating lever 4*a* is downwardly depressed by the door hook 3*a* to turn the switch 4 on. The interlock switch 4 is preferably employed in the form of a microswitch of any known construction and of a type having the actuating lever 4*a* and is mounted in position by means of a mounting piece D which may be secured to either the inside surface of the outer casing A or the outside surface of the enclosure B. The stopper 8 is integrally formed with this mounting piece D as is shown in FIGS. 1 to 3, but may be provided separately of the mounting piece D.

The mounting piece D carries, in addition to the interlock switch 4, a detector switch 7 having an actuating button 7*a*, which detector switch 7 is preferably in the form of a microswitch and is rigidly secured to mounting piece D with the actuating button 7*a* facing the door hook 3*a* of the door key 3 when assuming the engaged position. Also carried by the mounting piece D is a substantially L-shaped member 6 having a base portion secured to the mounting piece D and an upright portion 6*a* situated between the actuating button 7*a* and the door hook 3*a*. The substantially L-shaped member 6 is preferably made of elastic material so that the upright portion 6*a* thereof is elastically deformable relative to the base portion thereof which is secured to the mounting piece D. This L-shaped member 6 serves to avoid an erroneous switch-off of the detector switch 7 which may otherwise take place if a slight pulling force is applied to the door 1 so as to move the latter to the opened position. In other words, in view of the fact that, in most microswitches of a type having an actuating button such as shown by 7*a*, the actuating button is sensitive to a slight pushing force applied thereto, the switch 7 tends to be easily turned off if the value of an external pulling force F acting so as to move the door from the closed position to the opened position is excessively small. The employment of the L-shaped elastic member 6 is advantageous in that the upright portion 6*a* imparts a resistance to the force F of a slight value thereby avoiding an errorneous operation of the detector switch 7.

However, where the door 1 is designed such as to be moved from the closed position to the opened position with an external pulling force of a predetermined or reasonable value greater than the force necessary to depress the actuating button 7*a* of the detector switch 7 to turn the latter off and/or where a sufficient resistance is imparted to the actuating button 7*a* so that the latter can be depressed with the application of an external pushing force of a predetermined value, the L-shaped elastic member 6 may not be necessary and, therefore, may be omitted.

The assembly including the interlock switch 4, the L-shaped elastic member 6 if employed, the detector switch 7, the stopper 8 if not integrally formed with the mounting piece D and the mounting piece D may be prefabricated prior to these components being otherwise mounted to the microwave oven in such respective manners as hereinbefore described. In this case, care should be taken in positioning the detector switch 7 and the upright portion 6*a* of the L-shaped member 6 relative to the free end 8*a* of the stopper 8. Capability of prefabrication of the assembly facilitates adjustment of relative positioning of the components described above prior to the installation thereof and ensures an improved operative reliability.

The detector switch 7 employed in the embodiment of FIGS. 1 to 3 operates in the following manner.

In FIG. 3, a foreign matter 10 is shown as sandwitched or jammed in between the door 1 and a front portion panel 9 of the microwave oven around the access opening. As is well understood by those skilled in the art, the foreign matter 10 has an elasticity which varies depending upon the type of material of the foreign matter. Similarly, the door 1 has an elasticity which varies depending upon the type of material used to construct the door 1. In view of this, when the door 1 is held in the closed position with the foreign matter 10 jammed in between the door 1 and the front panel 9 as shown in FIG. 3, the door 1 is slightly outwardly deformed while the foreign matter 10 is compressed. Under this condition, the door 1 and the foreign matter 10, that have respectively been outwardly deformed and compressed, tend to restore to their original positions, substantially applying the external pushing force F to the door 1 even though no one has attempted to open the door 1 by applying the pulling force to the handle 2. The external pushing force F thus created is transmitted to the upright portion 6*a* of the L-shaped member 6 through the door hook 3*a*, which is in turn transmitted to the actuating button 7*a* of the detector switch 7 thereby turning the latter off. More particularly, when the external pushing force F acting on the door 1 so as to move the door 1 from the closed position to the opened position is transmitted to the upright portion 6*a*, the upright portion 6*a* of the L-shaped member 6 deforms against its own elasticity and, hence, the actuating button 7*a* of the detector switch 7 becomes depressed to switch the detector switch 7 off.

Figure 6:
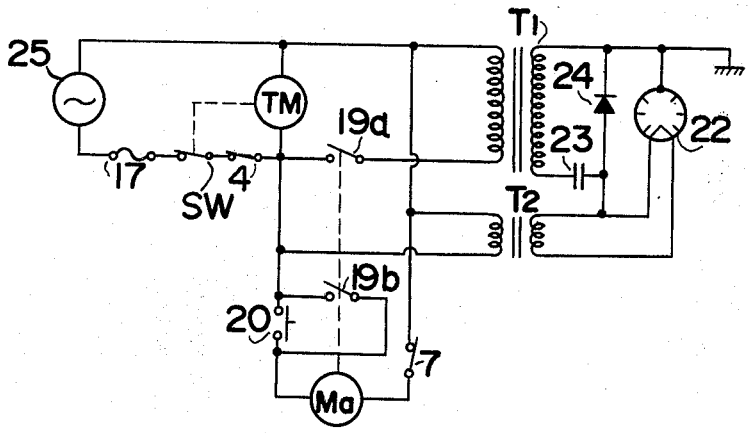
FIG. 6 is a circuit diagram showing an electric circuit employed in the microwave oven according to the present invention.

As shown in FIG. 6, since the detector switch 7 is electrically connected in series with the interlock switch 4 and is in turn inserted in a power supply circuit for the high frequency wave oscillator 22, the power supply circuit can be opened upon switch-off of the detector switch 7 even though the interlock switch 4 remains switched on.

Referring to FIG. 6, the power supply circuit includes a high voltage transformer T1 having a primary winding connected to a power source 25 through a magnet relay switch 19*a*, the interlock switch 4, a timer switch SW and a fuse 17, all connected in series between the primary winding of the transformer T1 and the power source 25. The timer switch SW in mechanically coupled to a motor-driven timer TM, timer switch SW being closed upon setting a cooking time on the timer TM. A series circuit composed of a push button switch 20, a magnet relay coil M*a* and the detector switch 7 is connected between the junction between the interlock switch 4 and the magnet relay switchh 19*a* and the power source 25. In parallel to the push button switch 20, another magnet relay switch 19*b* is connected. The secondary winding of the transformer T1 is connected to the high frequency wave oscillator 22. Reference numerals T2, 23 and 24 represent a transformer for applying a power to the high frequency wave oscillator 22 to heat the latter, a capacitor and a diode, respectively.

It will be readily seen that, during normal use of the microwave oven and upon switch-on of the push button switch 20, the magnet relay coil M*a* is energized and the relay switches 19*a* and 19*b* are simultaneously closed with the relay coil M*a* maintaining a self-energized state because of closure of the relay switch 19*b*. In the event that the foreign matter 10 is jammed in between the door 1 and the front panel 9, or otherwise any force is applied on the door so as to pivot the latter outwardly from the closed position to the opened position, the detector switch 7 becomes opened in the manner as hereinbefore described and, therefore, the power supply circuit is opened to render the high frequency wave oscillator 22 inoperative. Removal of the foreign matter 10 or the force applied to the door results in closure of the detector switch 7.

From the foregoing, it will readily be seen that the detector switch 7 can be turned off not only when the foreign matter 10 is jammed in between the door 1 and the front panel 9, but also when any external pulling force is applied to the door 1 so as to move the latter from the closed position to the opened position without the handle piece 5 depressed.

Figure 4:
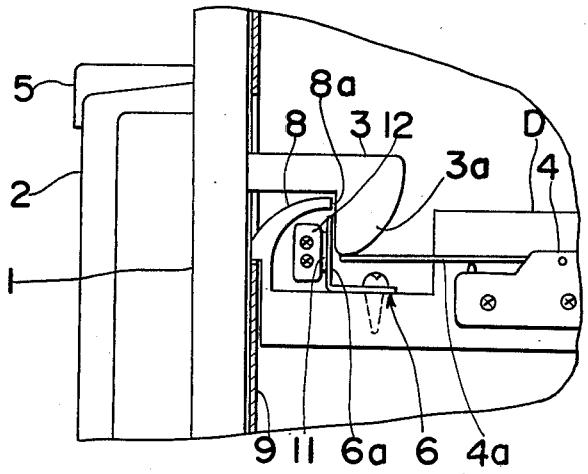
FIG. 4 is a similar view to FIG. 3, showing another preferred embodiment of the present invention.

In the embodiment shown in FIG. 4, the detector switch which has been described as employed as a microswitch in the foregoing embodiment, comprises a pressure sensitive element 12 of a type whose resistance varies in proportion to the pressure applied thereto. The pressure sensitive element employed in this embodiment of FIG. 4 opens the power supply circuit only when the pressure applied thereto through the upright portion 6*a* of the L-shaped member 6 exceeds a predetermined value. The employment of the pressure sensitive element for the detector switch in place of the microswitch is advantageous in that no play is required in between the door hook 3*a* and the upright portion 6*a* of the L-shaped member 6 and, therefore, the pressure sensitive element can readily respond to movement of the door hook 3*a* in a direction close to the pressure sensitive element. Preferably, in order to prevent a shock from being applied to the pressure sensitive element, a piece of elastic material having a sufficient elasticity is provided between the pressure sensitive element and upright portion 6*a* of the L-shaped member 6, as shown by 11. The piece of elastic material 11 may be plated, or otherwise adhered to either the pressure sensitive element or the upright portion 6*a* of the L-shaped member 6. This piece 11 serves as a cushioning instrument.

Figure 5:
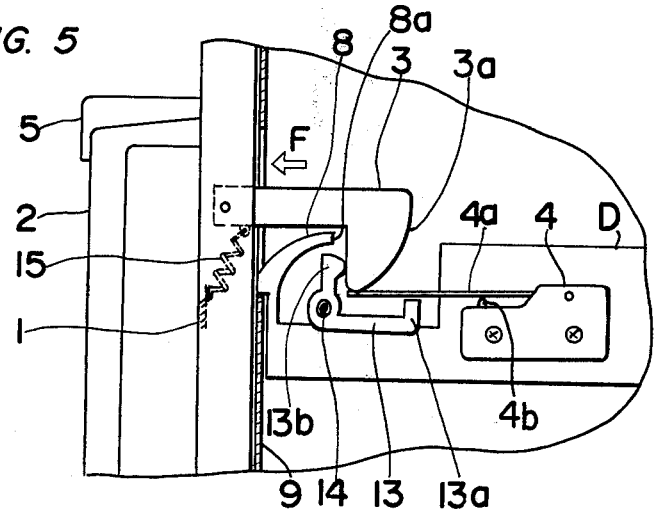
FIG. 5 is a similar view to FIG. 3, showing a further preferred embodiment of the present invention.

In the embodiment shown in FIG. 5, no electric switch such as the detector switch 7 which has been described as employed in any of the foregoing embodiments, is employed. Instead thereof, a substantially L-shaped pivotal lever 13 is employed. This pivotal lever 13 is pivotally supported by the mounting piece D as at 14 and has one end 13*a* situated below the actuating lever 4*a* adjacent a substantially intermediate portion of lever 4*a* and the other end 13*b* situated adjacent the door hook 3*a*. It will readily be seen that, assuming that the door 1 is held in the closed position with the door key 3 held in the engaged position as biased by the tension spring 15, application of the force F causes the door hook 3*a* to push the end 13*b* so that the pivotal lever 13 is pivoted counterclockwise about the pivot 14. As the lever 13 is thus pivoted counterclockwise, the end 13*a* of the lever 13 engages the lever 4*a* thereby upwardly shifting lever 4*a* while the free end of actuating lever 4*a* remains in engagement with the door hook 3*a* against its own resiliency. Therefore, as the substantially intermediate portion of the actuating lever 4*a* is thus upwardly shifted, the other end portion of the lever adjacent the body of the switch 4 tends to lift from the actuating button 4*b* so that the interlock switch, which has been closed, can be turned off.

In the embodiment of FIG. 5, it may be considered that the interlock switch 4 concurrently serves as the detector switch 7 which has been described as employed in the foregoing embodiments. The electric power supply circuit which can be employed in this embodiment of FIG. 5 is substantially identical with that shown in FIG. 6 except for the switch 7 being omitted.

Figure 7:
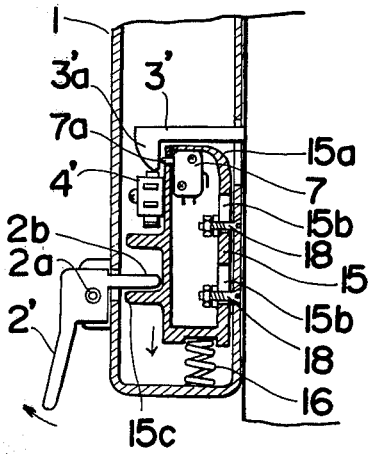
FIG. 7 is a side sectional view of an essential portion of the microwave oven, showing the detecting means according to a still further embodiment of the present invention.

The detector switch 7 may be provided in the door 1, an example of which is shown in FIG. 7. Referring now to FIG. 7, while the door key 3′ having the door hook 3′*a* extends from the front panel 9 of the microwave oven, the door 1 is in the form of a hollow frame. Housed within the hollow of the door 1 is a hollow slider 15 having one end substantially rounded as at 15*a* and the other end in contact with a compression spring 16 held between such other end of hollow slider 15 and a base portion of the door 1. The hollow slider 15 is formed as at 15*b* with one or more slots through which mounting screws 18 extend so that the hollow slider 15 can move up and down guided by mounting screws 18 in cooperation with the slots 15*b*. Normally, by the action of the compression spring 16, the hollow slider 15 is upwardly shifted. The upper corner of the hollow slider 15 opposed to the rounded corner 15*a* serves as a stopper for the door hook 3′*a* of the door key 3′. The interlock switch 4′ is supported in position so as to be closed by the door hook 3′*a* when the door is held in the closed position as shown and, for this purpose, the switch 4 may be secured to either the hollow slider 15 or an outer panel of the door 1. The detector switch 7, which comprises a microswitch having an actuating button 7*a*, is carried by the hollow slider 15 with actuating button 7*a* projecting outwardly through a wall portion of the hollow slider 15 and facing towards the door hook 3′*a*.

In the arrangement so far described, it will readily seen that, if an external pulling force is applied to the door 1 so as to move the latter from the closed position to the opened position while the door hook 3′*a* is engaged by the corner of the hollow slider 15 opposed to the rounded corner 15*a*, the hook 3′*a* pushes the actuating button 7*a* of the detector switch 7 thereby turning the latter off. Thus, the operation of the high frequency wave oscillator 22 can be stopped.

Opening of the door can be carried out merely by pivoting a handle 2′ about the pivot 2*a*, in which case a presser lever 2*b* integrally extending from the handle 2′ and situated within the hollow of the door 1 engages a projection 15*c* of the hollow slider 15, thereby causing the latter to move downwards against the compression spring 16. As the hollow slider 15 is thus downwardly moved against the compression spring, the corner of the slider 15 opposed to the rounded corner 15*a* disengages from the door hook 3′*a*.

From the foregoing full description of the present invention, it has now become clear that, when the door is in a shimmed condition or when the door, while held in a locked position, has applied thereto an external pulling force acting on the door so as to move the latter from the closed position towards the opened position, the high frequency wave oscillator halts operation to avoid a leakage of high-frequency electromagnetic energy which may otherwise take place through a gap formed between the door in the closed position and the front panel of the microwave oven.

It is to be noted that various changes and modifications are apparent to those skilled in the art without departing from the true scope of the present invention. By way of example, some type of microwave oven may have a plurality of door keys 3, in which case detector switches 7 or pivotal levers 13 may be provided one for each door key. Therefore, these changes and modifications are to be understood as included within the true scope of the present invention unless they depart therefrom.

What is claimed is:

1. In a microwave oven of the type including a casing structure defining an oven chamber, said casing structure being formed at one side thereof with an access opening communicating to said oven chamber, a door hingedly supported to said casing structure and selectively movable from an open position to a closed position for selectively opening and closing said access opening, means for radiating high-frequency electromagnetic energy into said oven chamber, and means for interlocking said door to said casing structure to lock said door in said closed position to close said access opening; the improvement comprising:

detecting means, mounted on one of said door and said casing structure at a position adjacent said access opening, for detecting the pressure of a gap between said door and said casing structure due to deformation of said door caused by the pressure of foreign matter between said door and said casing structure when said door is locked in said closed position by said interlocking means, and for halting operation of said radiating means upon the detection of such gap.

2. The improvement claimed in claim 1, wherein said detecting means is positioned to be operable by said interlocking means.

3. The improvement claimed in claim 2, wherein said detecting means comprises a microswitch, and said interlocking means comprises a door key positioned to actuate said microswitch when said door is deformed.

4. The improvement claimed in claim 1, wherein said detecting means comprises a microswitch.

5. The improvement claimed in claim 1, wherein said detecting means is mounted on said interlocking means.

6. The improvement claimed in claim 5, wherein said interlocking means comprises a door key pivotally supported on said door and having a door hook, a stopper engageable with said door hook to lock said door in said closed position, and an interlock switch positioned to be actuated by said door hook when said door is locked in said closed position; and said detecting means comprises a pivotally mounted lever positioned to be contacted by said door hook and to deactuate said interlock switch when said door is deformed.

7. The improvement claimed in claim 1, wherein said detecting means comprises a pressure sensitive element.

8. The improvement claimed in claim 7, further comprising cushioning means made of elastic material for supporting said pressure sensitive element.

9. In a microwave oven of the type including a casing structure defining an oven chamber, said casing structure being formed at one side thereof with an access opening communicating to said oven chamber, a door hingedly supported to said casing structure and selectively movable from an open position to a closed position for selectively opening and closing said access opening, means for radiating high-frequency electromagnetic energy into said oven chamber, and means for interlocking said door to said casing structure to lock said door in said closed position to close said access opening; the improvement comprising:

detecting means, mounted on said door and said casing structure at a position adjacent said access opening, for detecting deformation of said door caused by the application of an external force tending to move said door from said closed position to said open position when said door is locked in said closed position by said interlocking means, and for halting operation of said radiating means upon the detection of such deformation.

10. The improvement claimed in claim 9, wherein said detecting means is positioned to be operable by said interlocking means.

11. The improvement claimed in claim 10, wherein said detecting means comprises a microswitch, and said interlocking means comprises a door key positioned to actuate said microswitch when said door is deformed.

12. The improvement claimed in claim 9, wherein said detecting means comprises a microswitch.

13. The improvement claimed in claim 9, wherein said detecting means is mounted on said interlocking means.

14. The improvement claimed in claim 13, wherein said interlocking means comprises a door key pivotally supported on said door and having a door hook, a stopper engageable with said door hook to lock said door in said closed position, and an interlock switch positioned to be actuated by said door hook when said door is locked in said closed position; and said detecting means comprises a pivotally mounted lever positioned to be contacted by said door hook and to deactuate said interlock switch when said door is deformed.

15. The improvement claimed in claim 9, wherein said detecing means comprises a pressure sensitive element.

16. The improvement claimed in claim 15, further comprising cushioning means made of elastic material for supporting said pressure sensitive element.

17. In a microwave oven of the type including a double-walled casing structure, said casing structure including an outer casing open at one side thereof and an oven-defining metallic enclosure within and spaced from said outer casing, said enclosure having an access opening generally coincident with the open side of said outer casing, a door hingedly supported by said casing structure at the open side of said outer casing for pivotal movement between a closed position and an open position for selectively closing and opening said access opening of said enclosure, means for radiating high-frequency electromagnetic energy into the interior of said enclosure, means for interlocking said door and said casing structure to lock said door in said closed position to close said access opening during the operation of said radiating means, means operable in response to positioning of said door in said closed and locked position to thereby bring said radiating means in condition ready to operate, said radiating means being operated when a main switch inserted in an electric circuit of said radiating means between a source of electric power and said radiating means is switched on when said door is locked in said closed position; the improvement comprising:

a detector means positioned for detecting the presence or absence of an external force tending to move said door from said closed position to said open position when said door is locked in said closed position by said interlocking means, and for opening said circuit independent of said main switch upon the detection of the presence of such external force.

18. The improvement claimed in claim 17, wherein said detector means comprises a microswitch electrically inserted in said circuit separately of and in a series-connected manner with said main switch.

19. The improvement claimed in claim 17, wherein said detector means comprises a pressure sensitive element electrically inserted in said circuit separately of and in a series-connected manner with said main switch.

20. The improvement claimed in claim 17, wherein said detector means comprises a pivotable lever supported within a space between said outer casing and said enclosure at a position adjacent said access opening; and said operable means comprises a switch; said pivotable lever, upon detection of the presence of said external force, being movable by said interlocking means to turn off said switch.

* * * * *